US005336142A

United States Patent [19]

Dalebout et al.

[11] Patent Number: 5,336,142

[45] Date of Patent: Aug. 9, 1994

[54] STEPPER WITH ADJUSTABLE RESISTANCE MECHANISM

[75] Inventors: William T. Dalebout; Richard B. Ellis, both of Logan, Utah

[73] Assignee: Proform Fitness Products, Inc., Logan, Utah

[21] Appl. No.: 13,746

[22] Filed: Feb. 4, 1993

[51] Int. Cl.[5] ..... A63B 22/04; A63B 21/008

[52] U.S. Cl. ..... 482/52; 482/111

[58] Field of Search ..... 482/52, 53, 110, 111, 482/112, 113, 121, 905, 142, 148, 908

[56] References Cited

U.S. PATENT DOCUMENTS

| | | | |
|---|---|---|---|
| D. 304,358 | 10/1989 | Armstrong et al. . | |
| 3,638,941 | 2/1972 | Kulkens . | |
| 3,747,924 | 7/1973 | Champoux . | |
| 4,275,882 | 6/1981 | Grosser et al. . | |
| 4,426,077 | 1/1984 | Becker | 482/112 |
| 4,429,871 | 2/1984 | Flechner | 482/112 |
| 4,974,840 | 12/1990 | Welch | 482/142 |
| 4,993,706 | 2/1991 | Wilkinson | 482/142 |
| 5,062,627 | 11/1991 | Bingham | 482/53 |
| 5,078,390 | 1/1992 | Hurt . | |
| 5,129,872 | 7/1992 | Dalton et al. . | |
| 5,129,873 | 7/1992 | Henderson et al. . | |
| 5,145,476 | 9/1992 | Chiarello . | |
| 5,178,592 | 1/1993 | Yang | 482/53 |
| 5,184,994 | 2/1993 | Morris et al. | 482/905 |

FOREIGN PATENT DOCUMENTS

| | | | |
|---|---|---|---|
| 3941071 | 12/1990 | Fed. Rep. of Germany | 482/905 |

*Primary Examiner*—Stephen R. Crow

*Attorney, Agent, or Firm*—Trask, Britt & Rossa

[57] ABSTRACT

A stepping exercise machine has hydraulic cylinders to resist downward movement of its pedals or treadles and a bias spring to urge the pedals or treadles to their upper position of travel. A plurality of receptacles such as holes or slots interconnect with a hook associated with one end of the hydraulic cylinders to in turn vary the resistance to movement of the pedals or treadles.

14 Claims, 9 Drawing Sheets

STEPPER WITH ADJUSTABLE RESISTANCE MECHANISM

BACKGROUND OF THE INVENTION

1. Field:

This invention relates to exercise devices and is particularly related to stepping exercise machines.

2. State of the Art:

Exercise machines known as "steppers" typically include a pair of side-by-side levers, which may be variously configured, e.g. as pedals, pads or treadles. The levers are spaced apart and typically move up and down in what may be regarded as parallel planes. Some "steppers" include means for translating or synchronizing downward movement of one lever into upward movement of the other lever. Other versions have means to bias both levers to a raised position. In either case, an exercise is performed by sequentially stepping on the respective levers in a manner simulating climbing a flight of stairs. Such "steppers" include means to resist downward movement of the respective foot pads; and some such "steppers" have structure so the resistance may be varied or adjusted.

To use such a "stepper," the user performs a typical exercise routine in which weight is applied to one lever at a time in sequence to cause the levers to pivot in an arc against a resistance associated with each lever. At or about the same time the user applies weight to one lever, the user removes weight from the other lever to allow a biasing mechanism or a synchronizing mechanism to raise the other lever.

In one known stepping exercise machine, a resilient spring is positioned beneath arms supporting foot pads. Resistance to the downward movement of the levers, as well as return of the levers to a raised position, is provided by the springs.

Other available stepping exercise machines rely upon spring loaded fluid cylinders to provide resistance to downward lever travel and springs to return the levers to their raised positions.

Various mechanical arrangements have been provided to adjust the mechanical advantage through which the force applied to a lever and in turn the resistance to lever movement is provided by the resistance mechanism. These arrangements have tended to be expensive to fabricate, and their adjustment may require a degree of skill not possessed by typical users of the equipment or may require operating screws or nuts which may be difficult or frustrating to some users. There remains a need for a simple, easily used and inexpensive system for adjusting the degree of difficulty of exercises performed on low cost stepping exercise machines.

U.S. Pat. Nos. 4,838,543; 4,563,001; 4,989,858; 5,000,441; 5,062,627; 5,071,115 and 5,078,390 each disclose stepping exercise machines wherein hydraulic cylinders are used in conjunction with pivoted levers some of which have foot pads on the free ends thereof.

U.S. Pat. No. 4,838,543 discloses a stepping exercise machine having hydraulic resistance interconnected between a support post and a pair of pivoted arms having foot pads fixed to the free ends thereof. A synchronizing rope connector is used to raise one lever as the other is depressed. Resistance to depression of the levers is varied by changing the location of the connection of the shock absorbers using a wing nut and bracket through a slot along the lengths of the pivoted arms.

U.S. Pat. No. 4,563,001 discloses a stepping exercise machine having resistance cylinders each connected from beneath a pivoted lever arm. The connecting means between the resistance cylinders and the lever arms are adjustable with a screw along the lengths of the arms to vary the resistance encountered by a user in pushing down on the levers.

U.S. Pat. No. 4,989,858 discloses a stepping exercise machine providing a combination arm and leg exercising apparatus. In the disclosed device, a pair of foot pedals each have one end pivotally connected to a frame. An adjustable compressed spring tension device is connected between the frame and each foot pedal.

U.S. Pat. No. 5,000,441 discloses a machine having a pair of foot pedals each pivotally connected at one end to a support frame. A hydraulic cylinder is pivotally connected between a support post of the support frame and each foot pedal with no adjustment structure illustrated.

U.S. Pat. No. 5,062,627 discloses a stair stepper having hydraulic cylinders pivotally connected between a support post and pivotally mounted pedals. A reciprocator is provided to raise one pedal as the other is pushed down. The resistance may be adjusted using a screw or bolt interconnected to the cylinder through a series of holes.

U.S. Pat. No. 5,071,115 discloses a stepping exercise machine utilizing adjustable hydraulic cylinders as resistance means for steps and torsion springs to return the steps to a raised position.

U.S. Pat. No. 5,078,390 discloses a stair stepper with pivotally mounted foot support beams. Shock absorbers are pivotally connected to a support post and are adjustably connected along the lengths of the foot support beams to vary the resistance to downward movement of the support beam ends.

SUMMARY OF THE INVENTION

A stepping exercise machine has pivot arms pivotally mounted to an upstanding support member. The pivot arms travel in approximately parallel planes in conventional fashion.

A resistance mechanism of the type which resists extension and is normally biased towards a retracted condition is connected, either directly or indirectly, between the upstanding support member and each pivot arm. The resistance mechanism may be embodied as a simple spring, such as a coil spring or resilient stretchable band. The presently preferred embodiments of the invention utilizes a fluid cylinder. In any event, the resistance mechanism has a characteristic nominal length, and can be viewed as a link in a leverage system with the upstanding support member and the pivot arms.

In a preferred arrangement, structure carried by the first end of each resistance mechanism is pivotally connected to the upstanding support member. Structure carried by the second end of each resistance mechanism and structure associated with each of the respective pivot arms are cooperatively adapted to effect convenient couplings at selected locations. The presently preferred coupling arrangements are configured as hooks or equivalent connectors carried by the second ends of the resistance mechanisms registering with selected holes, slots, grooves channels, ribs, bosses or equivalent connection sites structurally associated with the pivot arms. In a more preferred arrangement, the hooks have a bearing surface to rotatably contact the pivot arms.

In one preferred embodiment, brackets are mounted on the housings of fluid cylinders which each engage a selected notch of a bracket carried by a pivot arm. The desired resistance is a pair of fluid cylinders each pivotally connected to a central support post of the upstanding support frame of the stepper.

In other embodiments, a J-hook is rotatably connected to the housing of each fluid cylinder and is positioned to extend into a slot and to engage one of a plurality of aligned holes formed adjacent to the slot in a top surface of a pivot arm. The telescoping rod of each resistance cylinder is pivotally connected to the central support post.

In the presently preferred embodiments of the invention, the resistance to downward movement of the pivot arms is increased as the connection points of the resistance mechanisms are moved away from the upstanding support. Adjustments to the resistance to downward pressure on a pivot arm are easily effected. The resistance mechanism is first allowed to return to its normally biased position. For example, the spring in a fluid cylinder will move the pivot arm to its fully raised position. Then, while the pivot arm is held in a raised position, force (downwardly) against the normal bias of the resistance mechanism will disengage the connection of the resistance mechanism from the pivot arm, (or associated structure). Continued downward force against the normal bias of the resistance mechanism will result in sufficient slack to allow the reconnection of the mechanism to the pivot arm at another location. Alternately, the user may simply urge the pivot arm upwardly from its fully raised position to mechanically disengage the pivot arm from its connection with the resistance mechanism.

The present invention thus provides a relatively low-cost, trouble-free stepping exercise machine that includes means for selectively adjusting the resistance to downward movement of the pivot arms of the device. The coupling structures, while simple, may take a variety of specific forms dependent upon the structural details of the pivot arms and associated structural members. Thus coupling may be effected either above, below or directly to the pivot arms and/or the foot pads.

BRIEF DESCRIPTION OF THE DRAWINGS

In the drawings which illustrate what is presently regarded as a preferred arrangement.

DETAILED DESCRIPTION OF THE ILLUSTRATED EMBODIMENTS

Figure 1:
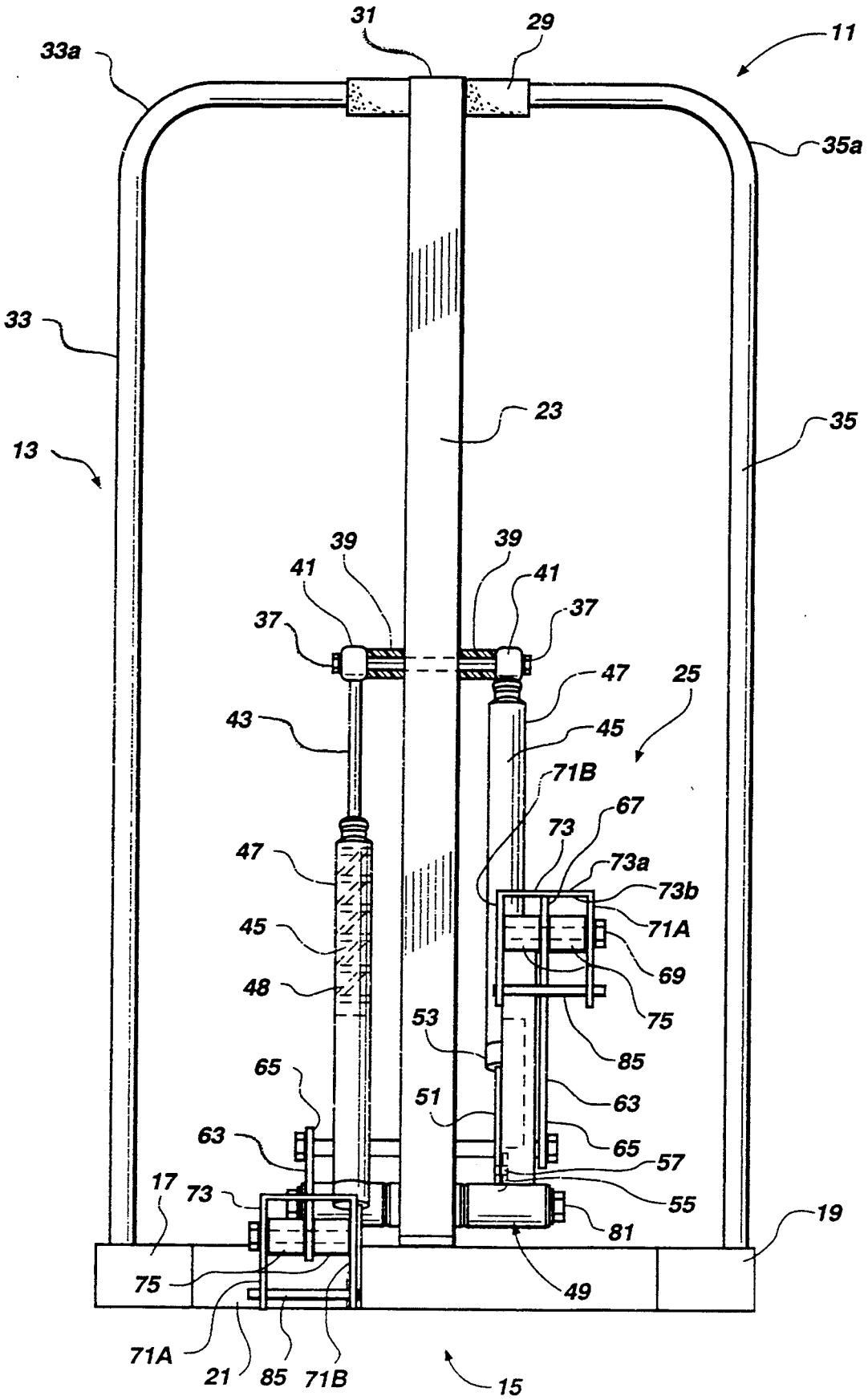
FIG. 1 is a rear elevation view of a first embodiment of the stepping exercise machine of the invention.
Figure 2:
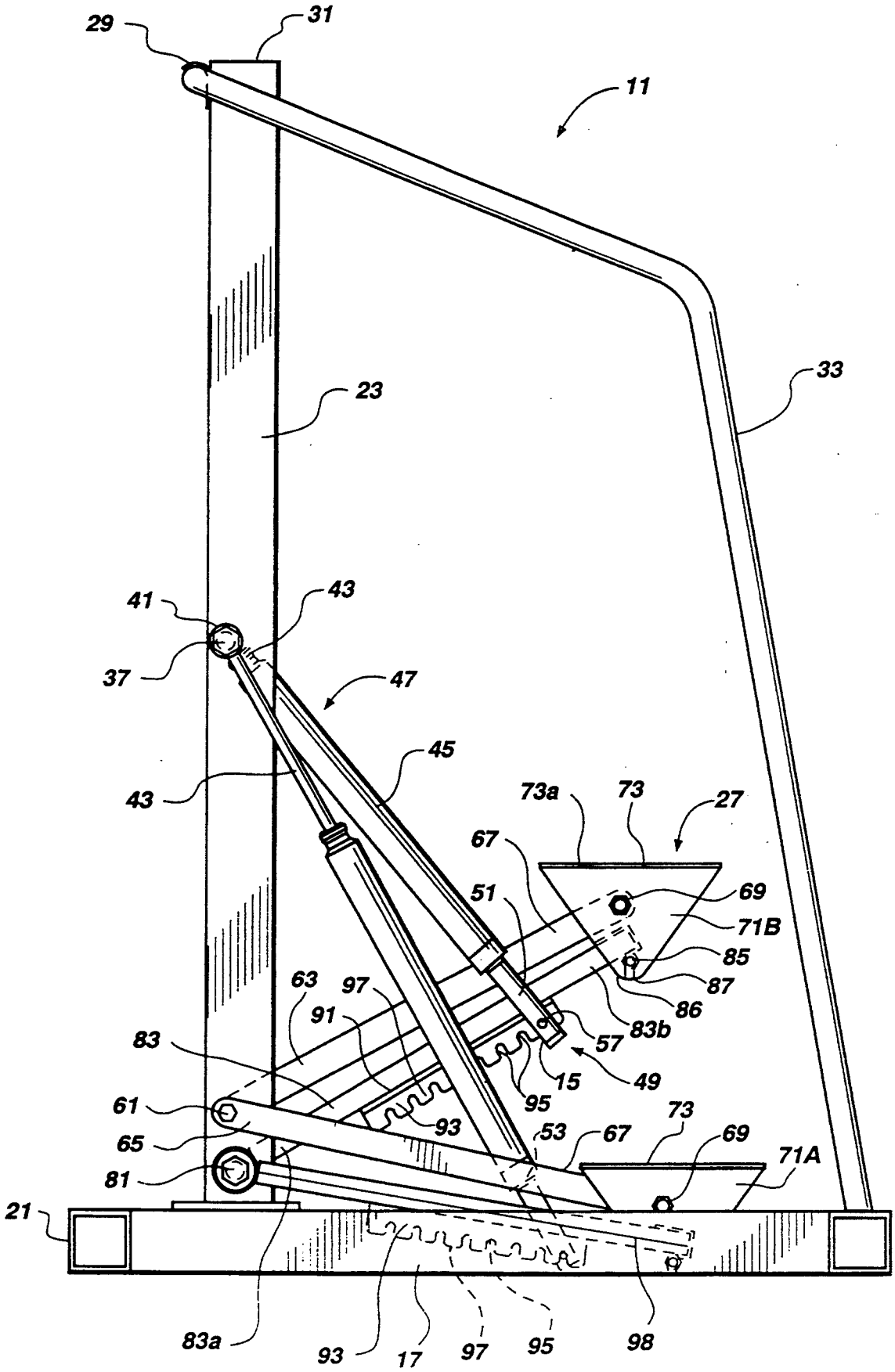
FIG. 2 is a side elevation view of the embodiment of FIG. 1.

In the illustrated embodiment of FIGS. 1 and 2, the stepping exercise machine of the invention 11 has a support frame 13 including a generally U-shaped base 15 with spaced apart parallel leg members 17 and 19 interconnected at forward ends by a front member 21. A support post 23 extends upwardly from the center of front member 21 to provide support for right and left step assemblies 25 and 27, respectively. As shown, the leg members 17 and 19, front member 21 and support post 23 are formed in a rectilinear cross-sectional configuration, but it will be apparent that other structural configurations could be used, if desired.

A cross-member 29, having an arcuate cross-sectional configuration, is fixed to and extends transversely across the upper end 31 of post 23. Support arms 33 and 35, respectively, extend upwardly from rear ends of leg members 17 and 19 and turn inwardly at 33A and 35A, respectively, to telescope into opposite ends of the cross-member 29.

A pivot shaft 37 extends through the post 23 to receive spacers 39 and journal rings 41 fixed to the ends of rods 43. The rods are held on the shaft by a hexagonal nut as shown in FIG. 2 or by any other means which will hold the journal rings 41 on the shaft 37. The rods 43 are arranged to telescope into and out of housings 45 of fluid cylinders 47.

Each housing 45 carries a support hook 49 which extends from the housing 45 opposite the telescoping rod 43. The hook 49 includes a shank 51, with one end 53 that is welded or otherwise affixed to the end of housing 45, and a reversely turned end 55. A pin 57 extends outwardly from reversely turned end 55 of the shank 51. Even though the hook 49 is shown here attached to and extending from the cylinder housing 45, it should be understood that the cylinder housing 45 has a journal similar to journal 41 and can be attached to the shaft 37 with hooks similar to hook 49 secured to the rods 43.

Each cylinder 45 has a spring 46 (shown in phantom) positioned to urge the piston 48 (shown in phantom) and to urge the left and right step assemblies 25 and 27 to their upper point of travel. Although a coil spring internal to the cylinder housing 45 is shown, the biasing force can be provided by springs or elastics positioned internal or external to the cylinder housing 45 and even by a rotational spring on the shaft 61 or 81. It should be noted that the right step assembly 25 is shown at its upper point of travel while the left step assembly 27 is shown at its lower point of travel. The left step assembly 27 thus is positioned as if the user were stepping or standing on it in use.

An axle shaft 61 extends through post 23 below pivot shaft 37. Pivot arms 63 are journaled at first ends 65 on opposite ends of the axle shaft 61. The other ends 67 of pivot arms 63 have a rod 69 centrally journaled thereto.

Rod 69 extends through a pair of spaced apart, delta-shaped side flanges 71A and 71B that depend from a flat foot pad 73 having a top 73A and a bottom 73B. Two spacers 75 are positioned on the rod 69 between the side flanges 71A and 71B to center the ends 67 of pivot arm 63 to in turn maintain the foot pads 73 in a centered position relative to pivot arms 63.

Another shaft 81 extends through the post 23, and journals through respective first ends 83A of a pair of stabilizing bars 83. A support rod 85 is fixed to and extends transversely of the respective second ends 83B of the bars 83. The support rod 85 fits into notches 87 formed in the apex end 86 of the delta-shaped side flanges 71.

One side 91 of an elongate L-shaped bracket 93 is fixed to a bottom surface of each stabilizing bar 83. Spaced notches 95 are formed in the other side 97 of bracket 93 and thus along a portion of the length 98 of the stabilizing bar 83.

The pin 57 of hook 49 is positioned in a selected notch 95 to establish the desired mechanical connection and the desired mechanical advantage to be obtained upon downward pressure on the foot pad 73 in extending the pneumatic cylinder rod 43 from its housing 45. Both the fluid and the spring in the cylinder resist extension of the rod 43. The change in mechanical advantage resulting as the pin 57 of hook 49 is repositioned in the notches 95 changes the force required on the foot pad to move or pivot the arm 63. Thus, movement of the pin 57 to a notch 95 closer to the foot pad 73 will decrease the mechanical advantage and increase the pressure required to push the foot pad down. When pressure is removed from foot pad 73, the spring (not shown) in the housing 45 moves rod 43 into housing 45 and raises the pivot arm 63 and foot pad 73.

Figure 3:
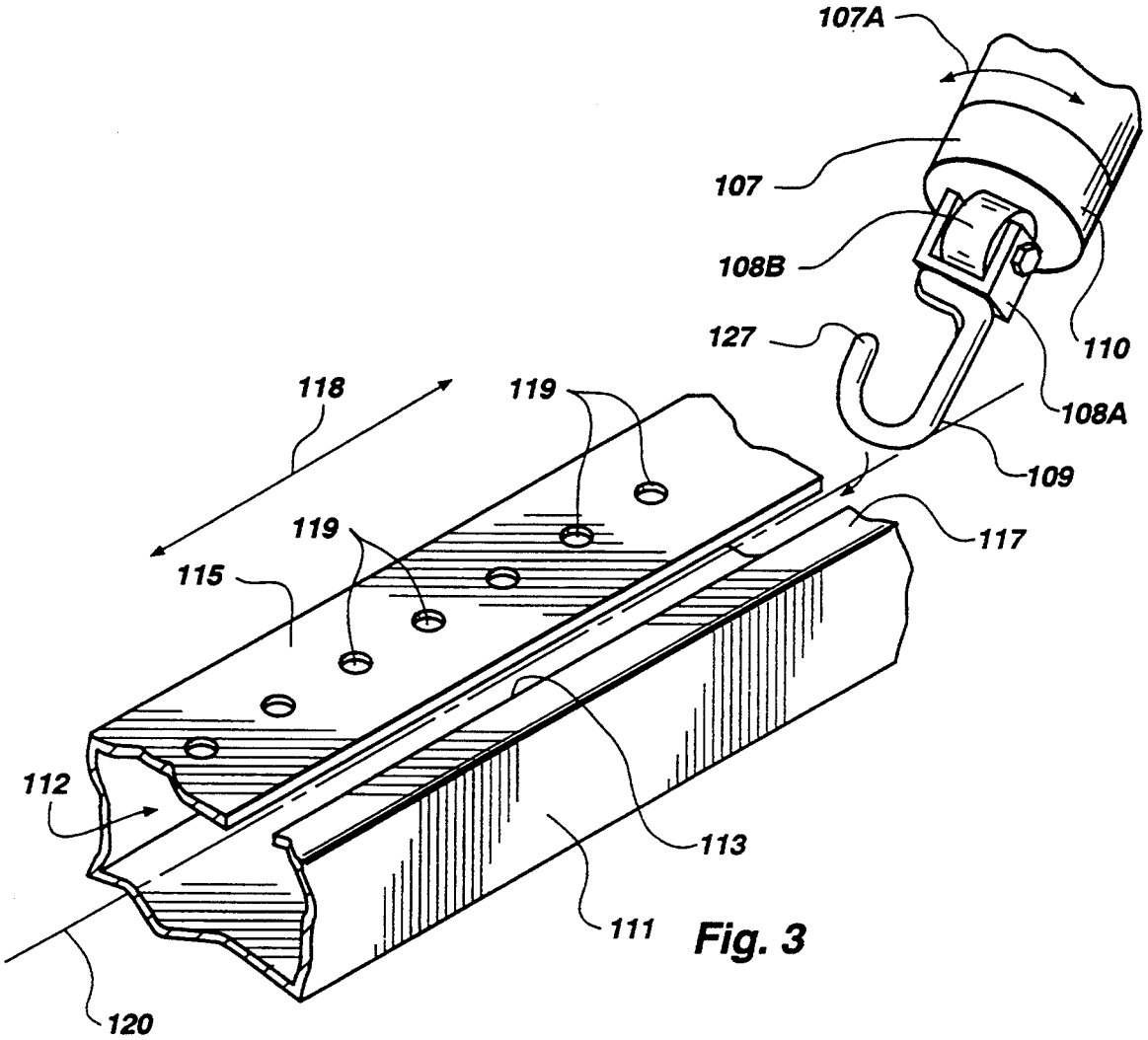
FIG. 3 is a fragmentary perspective view of a stabilizer bar and fluid cylinder of the exercise device of the invention.
Figure 4:
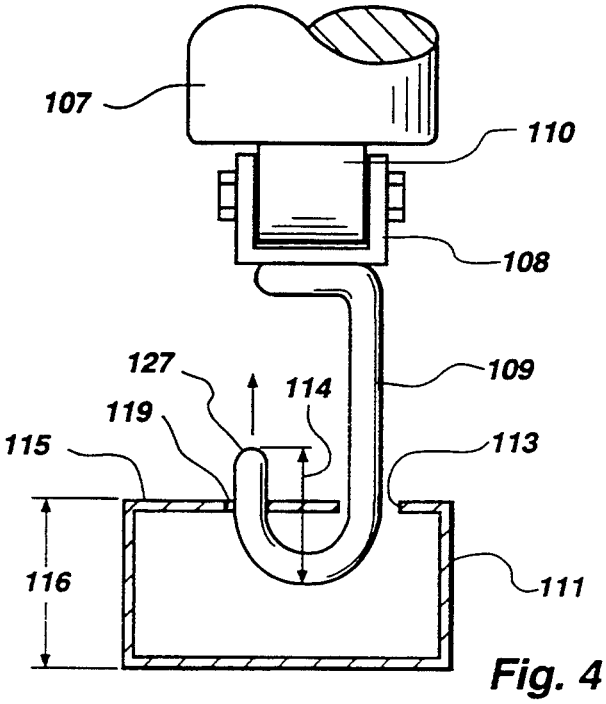
FIG. 4 is a fragmentary cross-sectional view through the lever of FIG. 3, but with the J-hook engaged.

FIGS. 3 and 4 illustrate an alternative means for connecting the fluid cylinder to left and right step assemblies 25 or 27. As shown, the fluid cylinder 107 has a J-hook 109 pivotably attached by yoke 108A to rotatably or pivotally connect to a corresponding bushing 108B fixedly secured to end 110 of the fluid cylinder 107 opposite the piston rod (not shown). In lieu of a pivot arm 63 and stabilizer bar 83 a single treadle 111 is used. The treadle 111 has a rectilinear cross section with a central longitudinal slot 113 extending only partially along its length 118 in the direction of axis 120. The slot 113 divides the top surface into segments 115 and 117. Spaced apart holes 119 aligned along and spaced from the slot 113 of the treadle 111 are formed through top segment 115.

Each treadle 111 is mounted to the post 23 in the same fashion as the pivot arms 63 previously described. The fluid cylinder 107 is connected, also as previously described, to the support post 23. With the tip 127 of the hook 109 inserted into a selected hole 119, the fluid cylinder 107 resists downward movement of the treadle 111. Further the yoke 108A rotates about bushing 108B as the treadle moves in an arc about its pivot axis (not shown) on post 23.

In practice, the treadle 111 may be held in place while the J-hook 109 is lowered and turned within the interior 112 of the treadle 111. The fluid cylinder 107 rotates 107A about its respective rod (not shown) to allow the J-hook 109 to be rotated so as to be inserted through the slot 113 to the interior 112. The cylinder 107 is then rotated again to move the J-hook 109 to be positioned to register with a selected hole 119; and the treadle 111 is then moved downwardly to engage the J-hook 109 in the selected hole 119.

The J-hook 109 can also be removed from the selected hole 119 in reverse fashion to be repositioned in another hole 119, if desired. That is, the J-hook can be held steady while the treadle 111 is urged upwardly from the upper point to disengage the hook from the hole 119. The hook can then be positioned in another hole 119 to change the resistance to movement of the treadle 111. Alternately, the hook 109 can then be rotated to align with the slot 113 so the treadle 111 and hook 109 can be separated if desired.

It should be noted that the hook 109 here shown has an arcuate portion to form the letter "J." Other shapes may be used so long as a mechanical connection is effected. Also the tip 122 of the hook 109 is formed here to have a length 114 less than the height 116 of the treadle 111 so that the hook 109 may be disengaged for selection of alternate holes or apertures 119 or for removal from the treadle 111.

Figure 5:
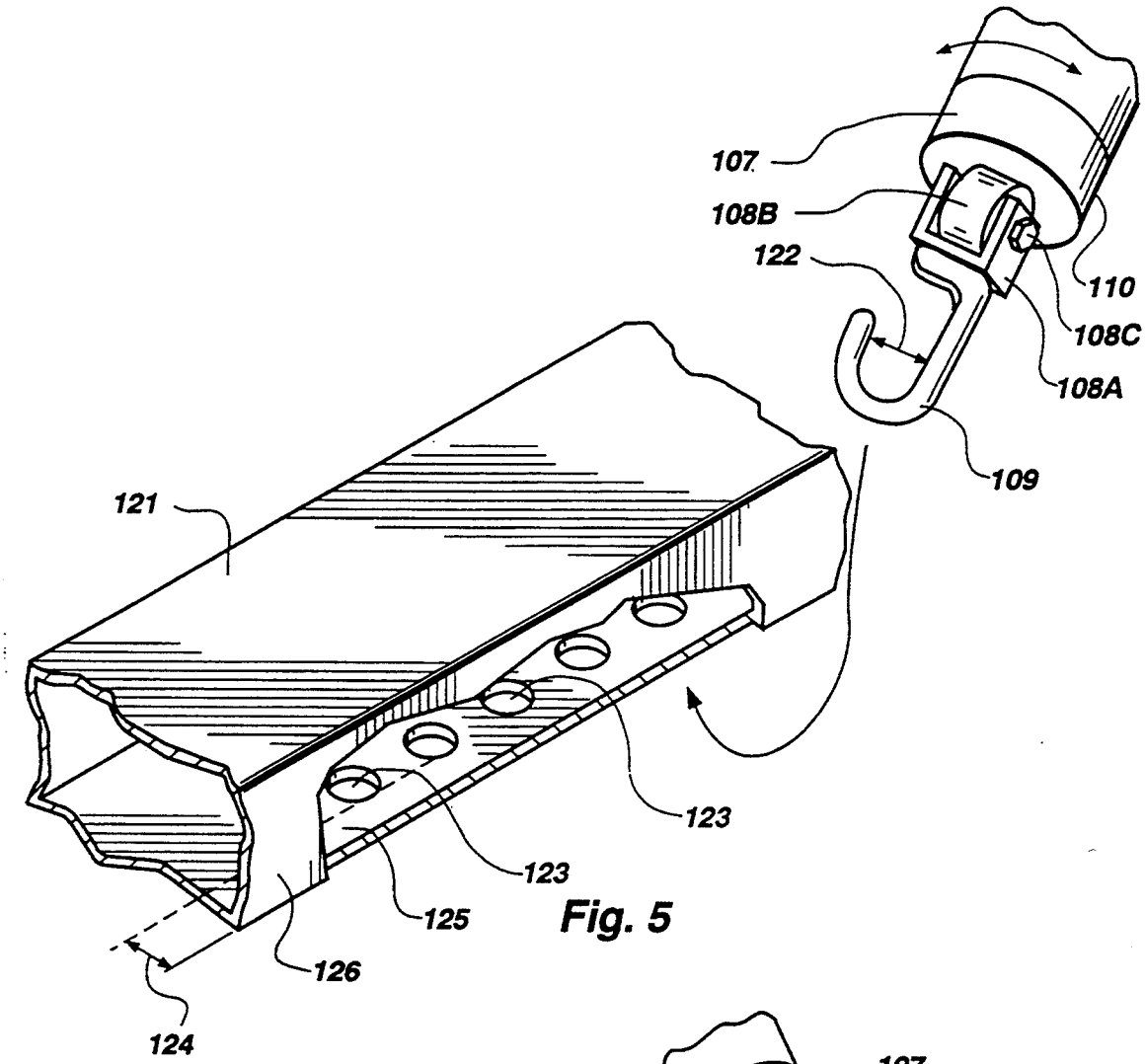
FIG. 5 is a fragmentary perspective view of a structural member configuration useful as either a pivot arm or stabilizer bar in association with a hook coupling element.

FIG. 5 shows another means for connecting the J-hook 109 to a treadle or stabilizer bar. In this embodiment, the treadle 121 is preferably formed to have a rectilinear cross-sectional configuration. A line of longitudinally spaced holes 123 is formed through a bottom surface 125. The J-hook 109 extends alongside the stabilizer bar and is inserted into a selected hole 123 to provide a desired mechanical advantage and to change the force required to push a treadle or the like downwardly in the manner previously described. As can be seen, the throat 122 of the J-hook 109 is larger than the distance 124. The holes 123 are spaced inwardly from the side 126 of the treadle 121.

As seen in FIG. 5, the J-hook has a yoke 108A interconnected to bushing 108B by axle bolt 108C. Thus, the J-hook can remain fixedly attached to the treadle 121 as it rotates in an arc about a pivot axle secured to post 23. That is, the yoke 108A rotates about bushing 108B as the treadle 121 rotates.

Figure 6:
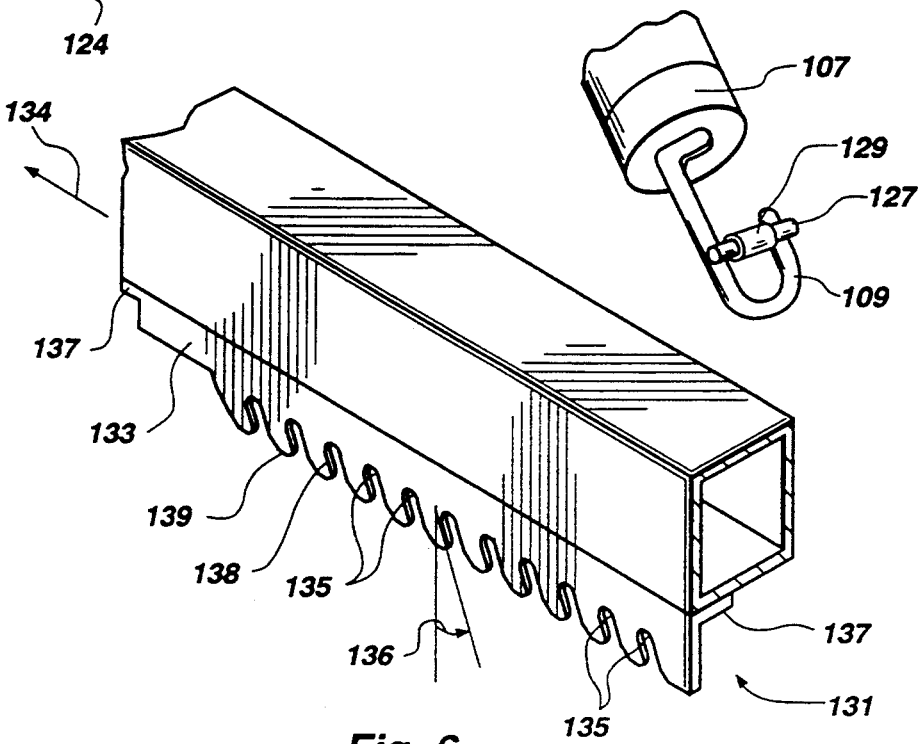
FIG. 6 is a fragmentary perspective view of an alternative bracket structure.
Figure 7:
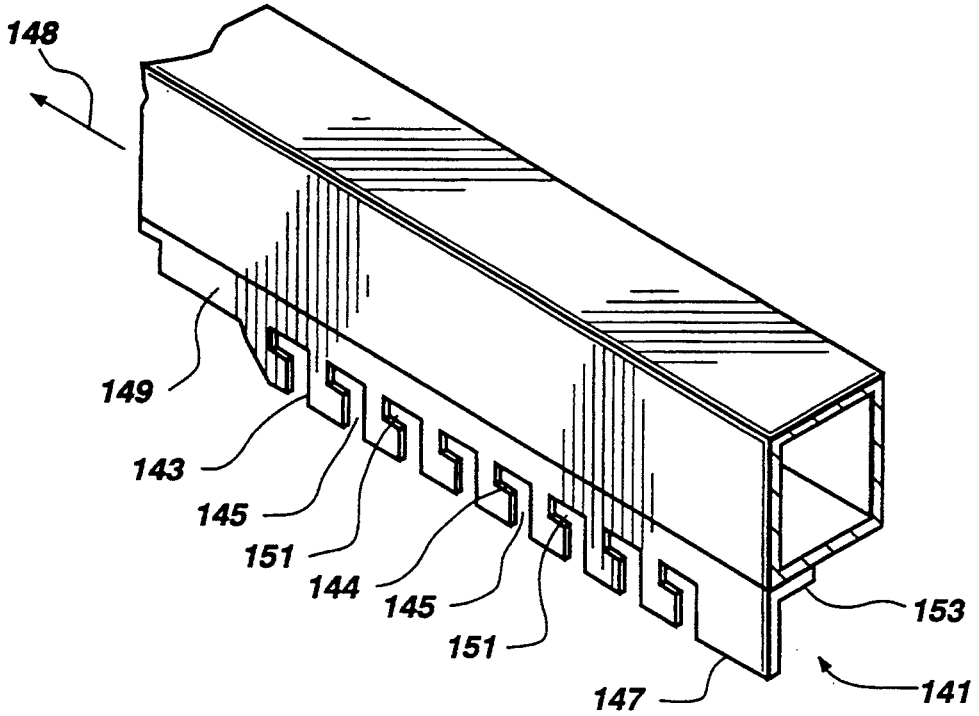
FIG. 7 is a fragmentary perspective view of another alternative bracket structure.
Figure 8:
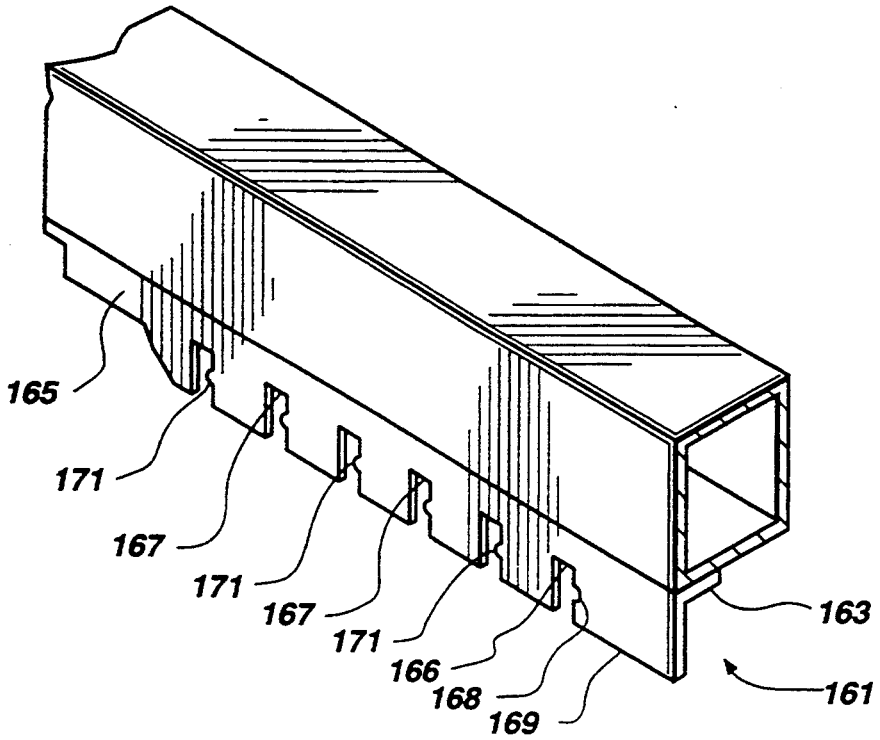
FIG. 8 is a fragmentary perspective view of still another alternative bracket structure.
Figure 10:
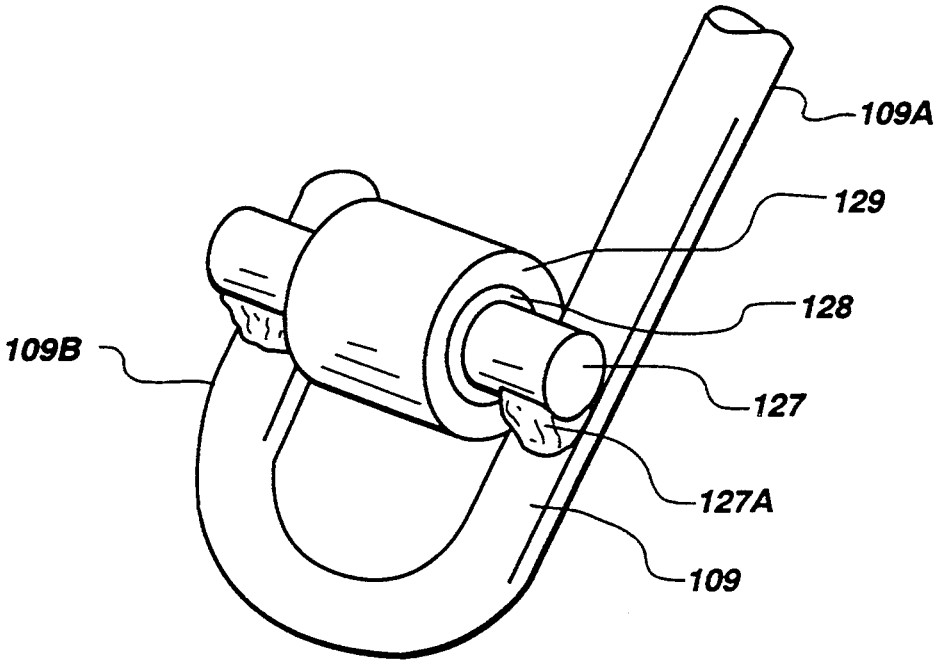
FIG. 10 is a partial view of an alternate configuration of an engagement member.

FIGS. 6, 7 and 8 each show an alternate bracket arrangement that may be used in place of the L-shaped bracket 93 with notches 95. Each of the brackets shown will receive either the pin 57 of hook 49, or the J-hook 109 as a connecting member. FIGS. 6 and 10, however, show a mild steel rod 127 welded to J-hook 109 with an inner bushing 128 and a hardened steel outer bushing 129 to provide a pivot mechanism for the J-hook 109. That is, the steel rod 127 is shown welded 127A or otherwise firmly secured essentially normal to the shank 109A and the toe 109B of the hook 109. The inner bushing 128 is mounted snugly to the rod 127 while bushing 129 is sized to snugly and rotatably fit about the inner bushing 128. Although the illustrated arrangement is preferred, other arrangements may be used to present a rotatable member such as bushing 129 to contact the surfaces of notches 135 (FIG. 6), notches 143 (FIG. 7) and notches 167 (FIG. 8).

The L-shaped bracket 131, shown in FIG. 6 is similar to bracket 93, previously described, and has a depending leg 133 with notches 135 spaced therealong. The outer bushing 129 snaps into notches 135. The other leg 137 of the bracket is adapted to be welded or otherwise affixed to a stabilizing bar 83 or treadle. The notches 135 in the leg 137 are angled 136 from the outermost edge 139 of the bracket to extend away from the post 23 and the outer end of the stabilizing bar or pedal to which the bracket 131 is affixed. That is the post 23 is not shown but in the direction of arrow 134. With the notches 135 angled in the manner described, as the stabilizing bar or treadle is raised, the connecting member (such as the outer bushing 129 on J-hook 109) is retained in the notch by a slight interference fit between outer bushing 129 and the selected notch 135.

FIG. 7 shows an L-shaped bracket 141, similar to the bracket 131 previously described with L-shaped notches 143. A first slot portion 145 extends to the outermost edge 147 of the projecting leg 149 of the bracket 141; and a transverse slot portion 149 extends from the first slot portion in the direction 148 of the post 23 or inward end of the stabilizing bar or treadle to which the bracket 141 is attached. The pin 57 or bushing 129 of J-hook 109 (FIG. 10) or other connecting member is positioned into the transverse slot portion 151 after movement through slot 145 and is held against inadvertent disconnection by the lower surface 144 of slot 151. Leg 153 of the bracket 141 is welded, or otherwise affixed, to a stabilizing bar or treadle such that the spaced notches 143 extend along the length of the stabilizing bar or treadle.

The bracket 161 of FIG. 8 is also similar to the brackets 131 and 141 previously described. Bracket 161 is preferably L-shaped, with a leg 163 that is welded or otherwise affixed to a stabilizing bar or treadle. Another leg 165 has spaced apart notches 167 formed therealong and extending into the leg from an outermost edge 169. Each notch 167 has a rounded element 171 extending thereinto from a sidewall of the notch and intermediate the length of the notch. The distance between the opposite sidewall and the detent is just sufficient to allow a pin 57 or bushing 129 of J-hook 109 of a connecting member to snugly pass through to the recessed end of the slot. When the connecting member is fully positioned in a selected notch 167, the element 171 prevents inadvertent release of the connecting member from the stabilizing bar or treadle. The bracket 161 is connected to the stabilizer bar such that the notches 167 are spaced along the length of the stabilizing bar or treadle.

Alternately, the notches may be formed with a detent 168 as shown in notch 166 of FIG. 8. The detent may receive the ball of a raised element or portion of the engagement member to register with the detent 168 to removably but snugly hold the engagement member in place. A spring loaded ball may also be positioned in the engagement member with the ball oriented to engage the detent 168.

Figure 9:
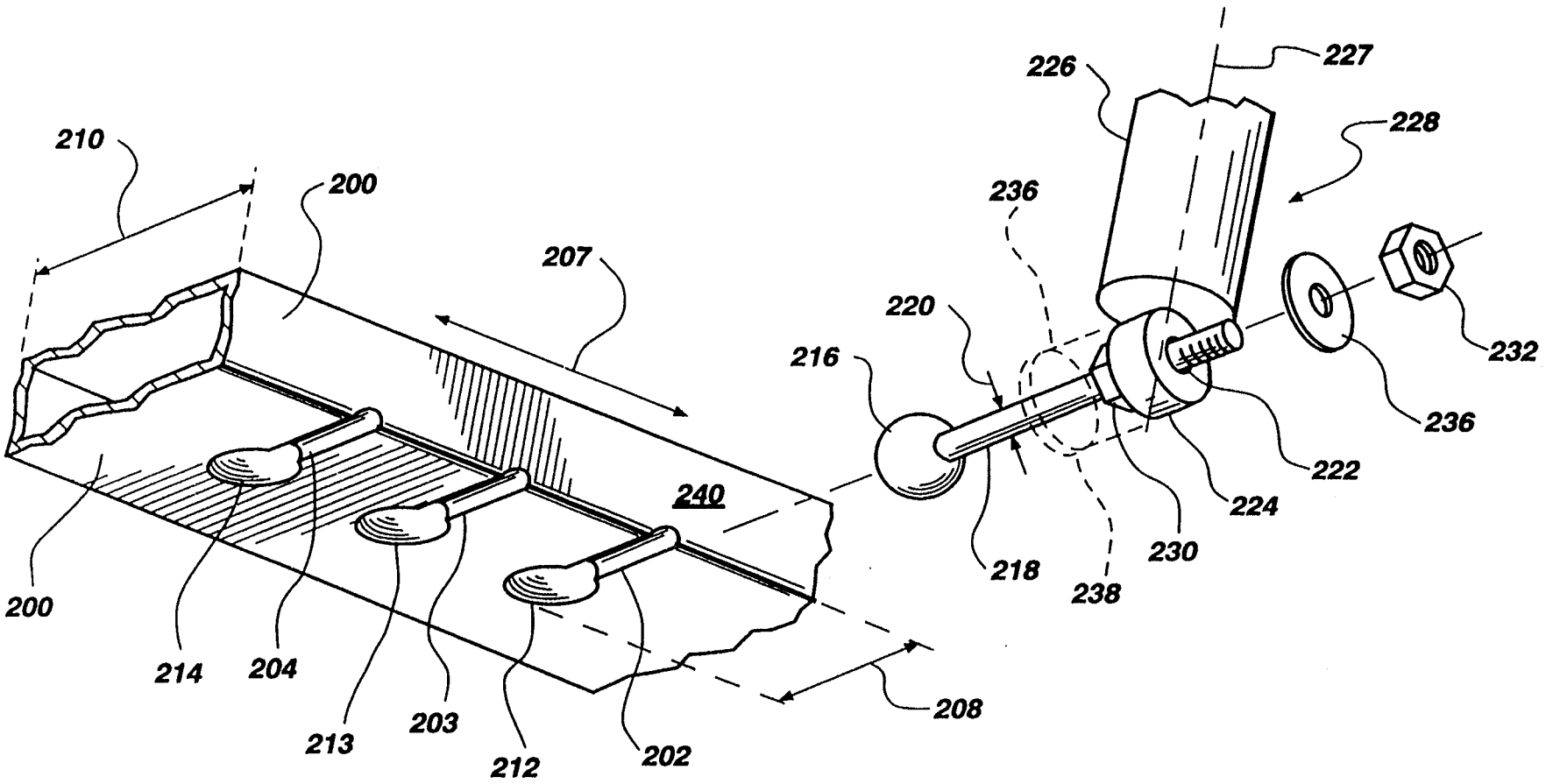
FIG. 9 is a fragmentary perspective view of an alternate bracket configuration.

Referring to FIG. 9, a treadle 200 is shown to be rectilinear in cross section with a plurality of spaced apart slots 202, 203 and 204 formed in the under surface 206. The slots 202–204 extend along the length 209 of the treadle 200. That is, slots 202–204 are formed in the treadle 200 as desired along a selected portion of or along the entire length of the treadle 200. The slots 202–204 extend inwardly a distance 208 selected to provide stability to the treadle 200 in use which distance is presently believed to be about one half the width 210 of the treadle 200. At the inward end of each slot 202–204, a recess 212, 213 and 214 is formed to snugly receive a shape which is here a ball or sphere 216 positioned on the end of shaft 218. The ball or sphere 211 has a diameter larger than the diameter of the shaft 218. The mechanical interrelationship of the ball 216 with the selected recess 212–214 provides for lateral or transverse stability in use. That is, transverse movement of the treadle 200 relative to the shaft 218 is inhibited.

As noted, the ball or sphere 216 is secured (by welding, threading or the like) to the shaft 218 which is in turn sized in diameter 220 to snugly fit through the aperture 222 of journal 224 which is fixedly secured to the cylinder housing 226 of resistance cylinder 228 similar in function to the resistance cylinders hereinbefore discussed. The shaft 218 is secured to be transverse to the axis 227 of the cylinder 228. The shaft 218 may be secured to the journal 224 by welding or other means. As here shown, the shaft 118 is secured by a first threaded nut 230 and a second threaded nut 232 on opposite sides of the journal 224. Appropriate washers 234 may be used to enhance the connection. A spacer 236 with an appropriate teflon, nylon or rubber-like pad 238 is attached to spacer 236. In turn, spacer 236 spaces the cylinder 228 from the side 240 of the treadle 200; and the pad 238 contacts the treadle surface 240 to reduce friction and minimize wear.

Figure 11:
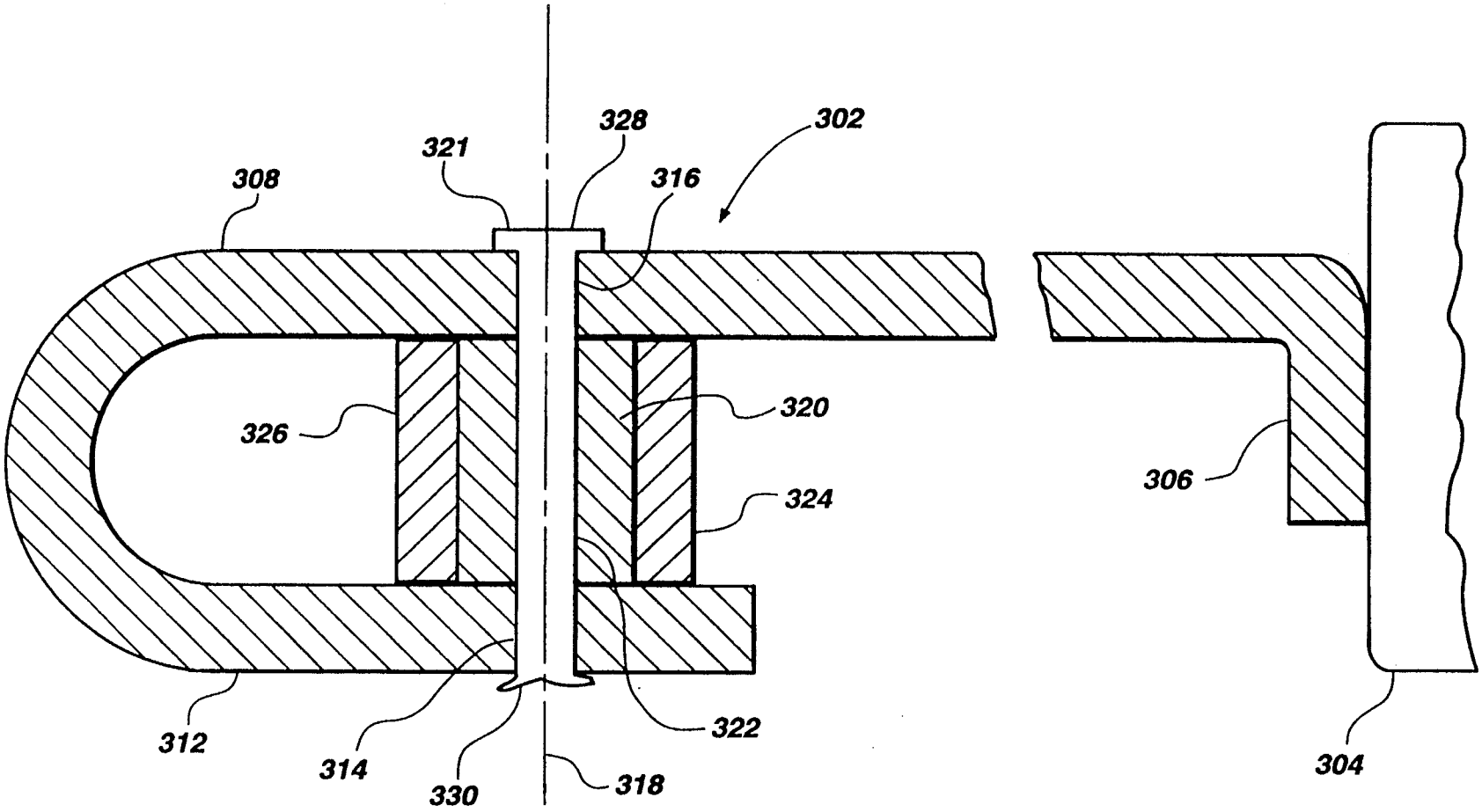
FIG. 11 is a partial cross-sectional view of an alternate J-hook of the invention.
Figure 12:
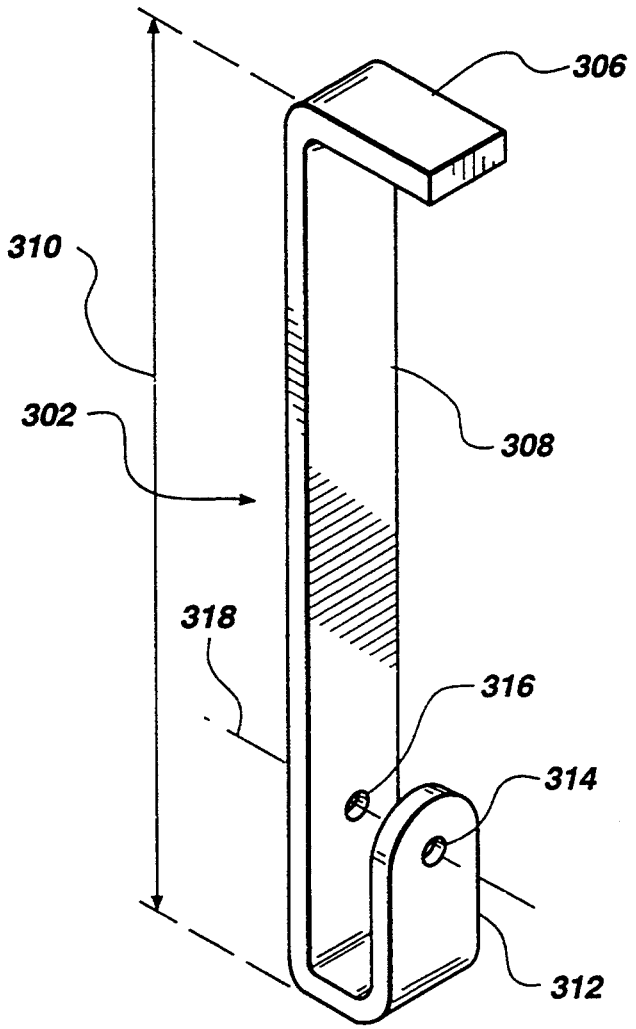
FIG. 12 is a partial perspective view of the J-hook of FIG. 11.

Referring to FIG. 11, an alternate but preferred J-hook 302 is depicted in cross section attached to a cylinder 304 in a manner similar to that shown in FIG. 6. FIG. 12 shows the J-hook 302 in perspective, formed from a single piece of strap metal with a flat top member 306 formed for attachment to the cylinder 304 by welding or other suitable securing means. The J-hook 302 has a main leg 308 which extends a preselected distance 310 which is sufficient to allow the user to hook into slots such as slots 135 in FIG. 6. In one preferred configuration, the distance is from about 3.5 inches to 4 inches.

The main leg 308 is connected to a short leg 312 which extends upwardly in general alignment with the main leg 308 to form a hook as shown. A first aperture 314 is formed in the short leg 312. A second aperture 316 is formed in the main leg 308 in alignment with the first aperture 314 along axis 318. The axis 318 is essentially normal to the main leg 308 and short leg 312.

As better seen in FIG. 11, an inner bushing 320 is positioned about a pin 321. The inner bushing 320 is sized to have an inner operative 322 sized to snugly but slidably and rotatably receive the pin 320 therethrough. The inner bushing 320 has an outer bushing 324 positioned snugly and rotatably thereabout. The outer bushing 324 is sized to fit in slots, such as slots 135 in FIG. 6.

Notably, the inner bushing 320 and outer bushing 324 are both made of steel and cylindrical in shape. The outer bushing 324 is preferably made of stainless steel and is rotatable about the inner bushing 320. In turn, the outer surface 326 is in frictional contact with the surface of the slot such as slot 135. In turn, the hook 302 can rotate relative to the slot when the machine is operated.

As depicted in FIG. 11, the pin 321 has a head 328 with a distal end 330 that is formed or shaped so that it may be hammered over to secure the pin 321 in the apertures 316 and 314. The pin 321 may be made of 1020 CRS to provide necessary strength and rigidity. As can be seen in FIG. 11, the bushings 320 and 324 also act as spacers to retain the desired separation between the main leg 308 and the short leg 312. In an alternate arrangement, the pin 321 may extend beyond leg 312 and have an aperture proximate that end to receive a cotter pin or similar securing structure.

The use of hydraulic cylinders to resist downward movement of the step assemblies 25 and 27 or treadles such as treadles 111 and 200 is presently preferred. However, other resistance arrangements which movably interconnect to the step assembly or treadle along its length including coil springs or the like may be used.

While preferred embodiments of the invention have been described with specific reference to the drawings, it should be understood that the invention is not thereby to be limited. Further it should be understood that the invention may be readily adapted for use with a wide variety of steppers including both those in which the pedals or treadles are synchronized and not synchronized.

What is claimed is:

1. An exercise machine comprising:

a frame for positioning on a support surface;

a pair of pivot arms each having a length and respective first ends pivotally connected to said frame to pivot toward and away from said support surface;

resistance means interconnectable between said frame and each of said pair of pivot arms for respectively resisting movement of each of said pair of pivot arms toward said support surface, said resistance means having an engagement member at one end thereof;

connection means associated with each of said pair of pivot arms for removably connecting said resistance means to at least one of said pivot arms, said connection means including a plurality of notches spaced along the length lower of at least one of said pair of pivot arms, each of said notches being sized to removably receive a said engagement member bushing means for providing a rotatable connection between said engagement member and said notches.

2. A stepping exercise machine of claim 1, further including:

a foot pad connected to respective second ends of each said pivot arm; and a pair of elongate stabilizer bars each having respective first ends pivotally connected to said frame and each extending from said frame to respective second ends which are each connected to one of said foot pads.

3. A stepping exercise machine of claim 1, wherein said connection means includes an elongate structure associated with each of said pair of pivot arms to extend along the length of each of said pair of pivot arms, and wherein said notches are formed along the length of said elongate structure, said notches being formed to removably receive said engagement member.

4. A stepping exercise machine of claim 3, wherein said resistance means includes a pair of fluid cylinders, each including a cylinder housing and cylinder rod extendable from said cylinder housing and moveable against resistance and biasing means positioned relative to said cylinder to urge said cylinder rod to a retracted position within said cylinder housing.

5. A stepping exercise machine of claim 4, wherein each of said fluid cylinders includes securing means at a first end thereof to pivotally mount said fluid cylinder to said frame, and wherein said connection means is associated with each of said pair of fluid cylinders at a second end thereof.

6. A stepping exercise machine of claim 5, wherein said engagement member includes a member extending transversely to the axis of its respective fluid cylinder, and wherein said engagement member is sized to engage said notches.

7. The stepping exercise machine of claim 5, wherein said engagement member is a J-shaped member.

8. A stepping exercise machine of claim 2, wherein each foot pad has a top, a pair of spaced apart side members extending from said top and means for journaling the second end of each said pivot arm to at least one of said spaced apart side members.

9. A stepping exercise machine of claim 8, wherein each of said elongate stabilizer bars is rotatably secured to a said foot pad under said pivot arms and is sized in length to hold said foot pad in a selected orientation relative to said support base.

10. A stepping exercise machine of claim 9, wherein said connection means includes an elongate structure associated with each of said pair of stabilizer bars to extend along the length of each of said pair of stabilizer bars.

11. A stepping exercise machine of claim 3, wherein each of said notches is formed at an angle away from said support member.

12. A stepping exercise machine of claim 3, wherein each of said notches is L-shaped to have a transverse slot which extends toward the support member.

13. A stepping exercise machine of claim 3, wherein each of said notches has a securing means for removably securing said engagement means therein.

14. A stepping exercise machine of claim 13, wherein said securing means is a raised element formed in the side of each said notch to retain said engagement member by an interference fit.

* * * * *